US007118399B1

(12) United States Patent
Wen et al.

(10) Patent No.: US 7,118,399 B1
(45) Date of Patent: Oct. 10, 2006

(54) ELECTRONIC DEVICE WITH REPLACEABLE PLUG

(75) Inventors: Chun Wen, Taoyuan Hsien (TW); Chun-Chen Chen, Taoyuan Hsien (TW)

(73) Assignee: Delta Electronics, Inc., (TW)

( * ) Notice: Subject to any disclaimer, the term of this patent is extended or adjusted under 35 U.S.C. 154(b) by 0 days.

(21) Appl. No.: 11/258,431

(22) Filed: Oct. 25, 2005

(30) Foreign Application Priority Data

May 9, 2005 (TW) ..... 94114967 A

(51) Int. Cl.
*H01R 29/00* (2006.01)

(52) U.S. Cl. ..... 439/166; 439/518

(58) Field of Classification Search ..... 439/166, 439/518, 172, 218, 956
See application file for complete search history.

(56) References Cited

U.S. PATENT DOCUMENTS

| | | | | |
|---|---|---|---|---|
| 5,906,509 | A * | 5/1999 | Wu | 439/518 |
| 6,086,395 | A * | 7/2000 | Lloyd et al. | 439/172 |
| 6,845,023 | B1 * | 1/2005 | Philips et al. | 363/132 |
| 7,008,246 | B1 * | 3/2006 | Zhuge | 439/173 |

* cited by examiner

*Primary Examiner*—Tho D. Ta
*Assistant Examiner*—Vanessa Girardi

(57) ABSTRACT

An electronic device with a replaceable plug is disclosed. The electronic device comprises a main body, a fixing element and a plug. The main body has an upper casing and a lower casing, and a plug-receiving portion is disposed at the bottom of the lower casing. The fixing element has a hook portion and a press portion, in which the hook portion is protruded in the plug-receiving portion, and the press portion is disposed on the surface of the upper casing. The plug has plural conducting terminals and an engaging plate. Via the engagement between the engaging plate of the plug and the hook portion of the fixing element, the plug can be assembled in the plug-receiving portion of the main body. Furthermore, the plug can be easily dissembled from the main body by pressing the press portion.

20 Claims, 6 Drawing Sheets

ELECTRONIC DEVICE WITH REPLACEABLE PLUG

FIELD OF THE INVENTION

The present invention relates to an electronic device with a replaceable plug, and more particularly to a power converter with a replaceable plug.

BACKGROUND OF THE INVENTION

With the progress of technology, various electronic equipments become indispensable tools in our daily life. The power converter functions to convert the commercial AC power into DC power to be utilized by the electronic equipments. For example, the adapter of a notebook, or the charger of a cellphone or a digital camera, is a kind of power converter.

The power converter includes a plug for plugging into a socket to receive the commercial power. Since the international business is well developed and the leisure life quality is much valued nowadays, people frequently and frequently go abroad for business or travel, and usually carry the portable electronic products, such as notebooks, cellphones and digital cameras, when they go abroad. However, there are various kinds of socket standards in the world, so the power converter is usually connected with a connector having different forms of conductive terminals to adapt to different socket standards.

Currently, there are some universal plugs available in the market, but they just simply connect with the power converter without providing the securing function. However, while using the connector, if the connector cannot be effectively secured on the power converter, the connector may be remained on the socket when pulling out the power converter, which may cause a danger of electric shock. In addition, the power converter may be loosened and dissembled from the connector, which may cause power failure of the electronic equipment or data loss.

To overcome the disadvantages of the prior art described above, the present invention provides a power converter with a detachable plug, which can be designed according to different socket standards and has an engaging structure corresponding to the power converter so as to be effectively secured on the power converter and can be easily assembled with or disassembled from the power converter.

SUMMARY OF THE INVENTION

An object of the present invention is to provide an electronic device with a replaceable plug, which can be effectively secured on the main body of the electronic device and can be easily assembled with or disassembled from the main body of the electronic device.

According to an aspect of the present invention, there is provided an electronic device with a replaceable plug, and the electronic device comprises a main body, a fixing element and a plug. The main body has an upper casing and a lower casing, and the lower casing has a plug-receiving portion disposed at a bottom thereof. The fixing element has a hook portion and a press portion, in which the hook portion is protruded in the plug-receiving portion and the press portion is disposed on a surface of the upper casing. The plug has a plurality of conducting terminals and an engaging plate to be engaged with the hook portion of the fixing element. The plug is assembled in the plug-receiving portion of the main body via an engagement between the engaging plate of the plug and the hook portion of the fixing element, and dissembled from the main body by pressing the press portion.

In an embodiment, the electronic device is a power converter, such as an adaptor or a charger.

In an embodiment, the plug-receiving portion is a depression.

In an embodiment, the plug-receiving portion comprises two side plates disposed at two sides thereof, which are extended inwardly from bottom edges of the lower casing.

In an embodiment, each of the side plates comprises at least an indentation, and the plug comprises at least a protrusion disposed correspondingly to the indentation of the side plate.

In an embodiment, the plug-receiving portion further comprises at least a block.

In an embodiment, the plug-receiving portion further comprises at least a conducting piece, and the plug further comprises at least a contact to conduct with the conducting piece in the plug-receiving portion.

In an embodiment, the plug further comprises a plastic body and a base to be received in the plug-receiving portion, and the engaging plate is disposed on the base.

In an embodiment, the fixing element further comprises a connecting portion for connecting the hook portion and the press portion.

In an embodiment, the hook portion comprises an engaging hook at an end thereof, and the engaging hook has a slant surface.

In an embodiment, the fixing element further comprises at least a hook piece, which is extended downwardly from the press portion.

In an embodiment, the upper casing of the main body further comprises at least an engaging piece to be engaged with the hook piece.

In an embodiment, the electronic device further comprises a spring disposed between the press portion and the upper casing.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention relates to an electronic device with a replaceable plug. The present techniques are illustrated with the following embodiments for a power converter, but the electronic device that is applicable to the present techniques is not limited to the power converter. Any electronic device that is applicable to the following techniques is incorporated herein for reference.

Figure 1:
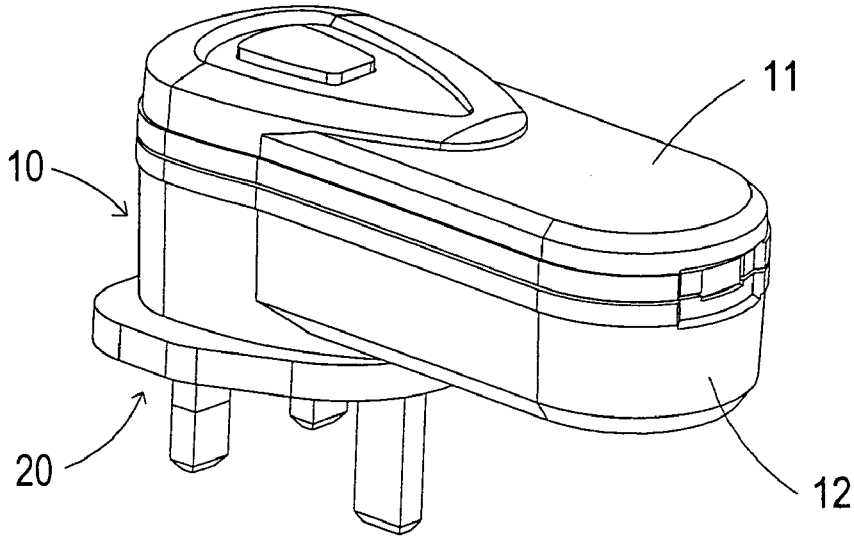
FIG. 1 is a schematic diagram showing the electronic device with a replaceable plug according to the preferred embodiment of the present invention.

Please refer to FIG. 1, which is a schematic diagram showing the electronic device with a replaceable plug according to the preferred embodiment of the present invention. As shown in FIG. 1, the electronic device, such as a power converter, mainly comprises a main body 10 and a plug 20. The main body 10 comprises an upper casing 11 and a lower casing 12, and the plug 20 is assembled with the main body 10 at the bottom of the lower casing 12.

Figure 2:
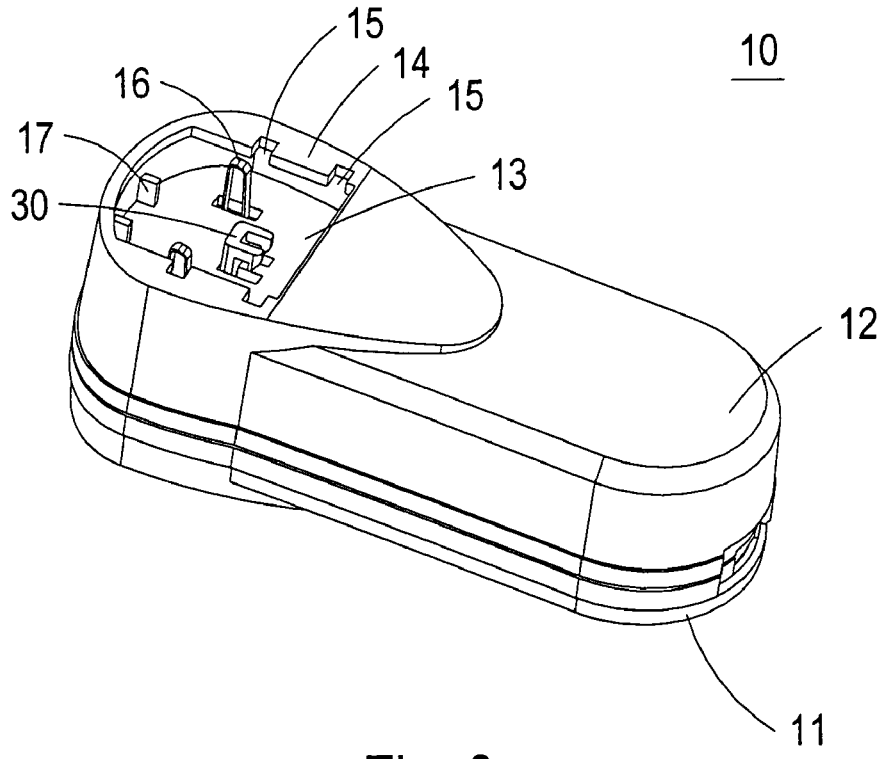
FIG. 2 is a schematic diagram showing the main body of the electronic device according to the preferred embodiment of the present invention.

Please refer to FIG. 2, which is a schematic diagram showing the main body of the electronic device according to the preferred embodiment of the present invention. As shown in FIG. 2, there is a plug-receiving portion 13, which is a depression, disposed at the bottom of the lower casing 12 for receiving the plug 20. Two side plates 14 are disposed at two opposite sides of the plug-receiving portion 13, respectively. The side plates 14 are extended inwardly from bottom edges of the lower casing 12, and are formed integrally with the lower casing 12. Each of the side plates 14 has two indentations 15 serving as guiding slots for assembling the plug 20 and the main body 10 of the electronic device. There are two conducting pieces 16 disposed in the plug-receiving portion 13 for contacting the contacts 24 (shown in FIG. 6(*b*)) on the plug 20. In addition, the electronic device further comprises a resilient fixing element 30, which is protruded in the plug-receiving portion 13 and can be engaged with the corresponding structures of the plug 20; the detailed structures of the fixing element 30 and the plug 20 will be illustrated in the following descriptions. Moreover, the plug-receiving portion 13 further comprises two blocks 17 disposed at the back side of the fixing element 30 for positioning the plug 20 when assembling the plug 20 and the main body 10 of the electronic device.

Figure 3:
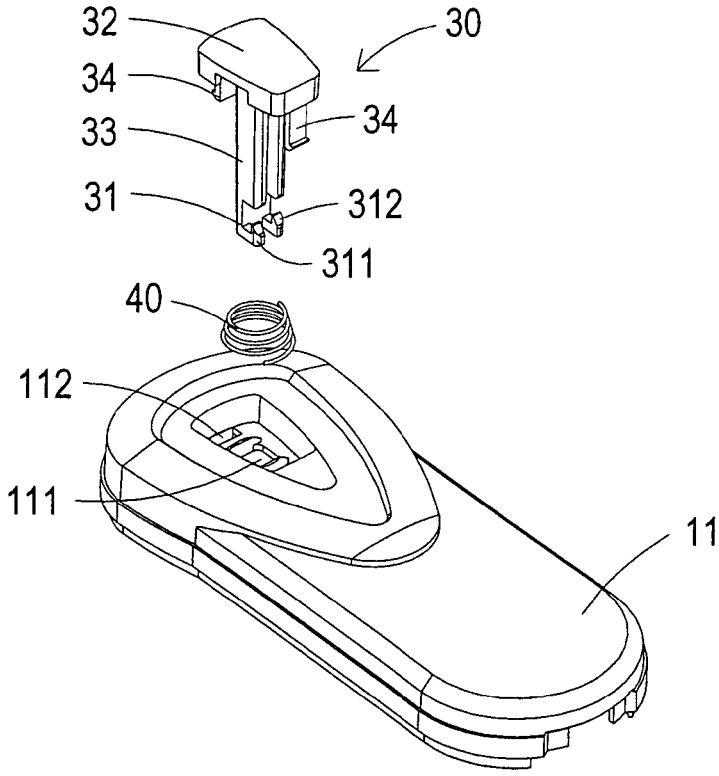
FIGS. 3 and 4 are schematic diagrams showing the assembling of the fixing element and the upper casing according to the preferred embodiment of the present invention.
Figure 4:
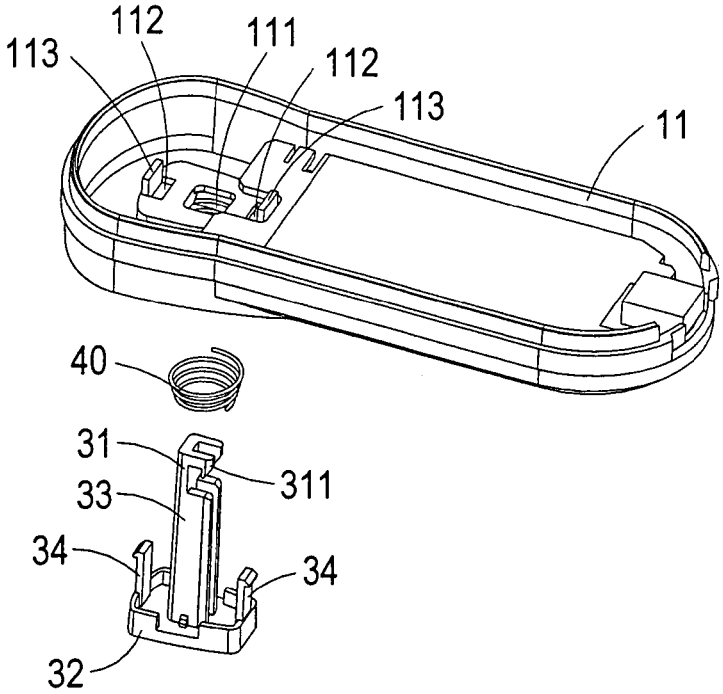

Please refer to FIGS. 3 and 4, which are schematic diagrams showing the assembling of the fixing element and the upper casing according to the preferred embodiment of the present invention. As shown in FIGS. 3 and 4, the fixing element 30 comprises a hook portion 31, a press portion 32, and a connecting portion 33 connecting the hook portion 31 and the press portion 32, wherein the hook portion 31 is L-shaped and has an engaging hook 311 at the end thereof, and the engaging hook 311 has a slant surface 312 thereon. When assembling the fixing element 30 and the upper casing 11, a spring 40 is first slipped and put around the connecting portion 33 near the press portion 32, and then the hook portion 31 and the connecting portion 33 pass through a first hole 111 on the upper casing 11. For securing the fixing element 30 on the upper casing 11, the fixing element 30 further comprises two hook pieces 34 extended downwardly from the press portion 32. When the connecting portion 33 passes through the first hole 111 on the upper casing 11, the hook pieces 34 also pass corresponding second holes 112 on the upper casing 11 and are engaged with the engaging pieces 113 on the upper casing 11, as shown in FIG. 5, so as to secure the fixing element 30 on the upper casing 11.

Figure 5:
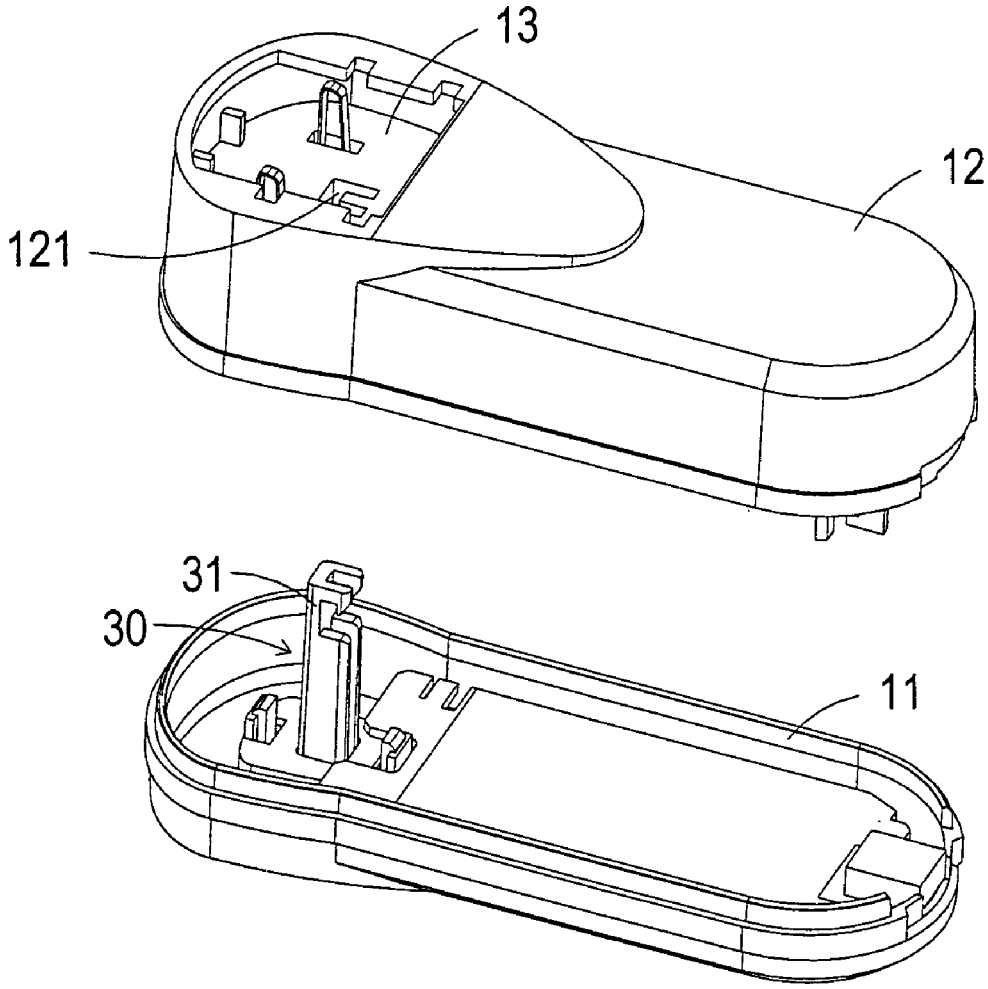
FIG. 5 is a schematic diagram showing the assembling of the upper casing and the lower casing according to the preferred embodiment of the present invention.

Please refer to FIG. 5, which is a schematic diagram showing the assembling of the upper casing and the lower casing according to the preferred embodiment of the present invention. As shown in FIG. 5, the plug-receiving portion 13 of the lower casing 12 has a third hole 121 corresponding to the fixing element 30. After the fixing element 30 is assembled on the upper casing 11, the fixing element 30 passes the third hole 121 of the lower casing 12, and the upper casing 11 and the lower casing 12 are assembled together; meanwhile, the hook portion 31 of the fixing element 30 is protruded in the plug-receiving portion 13 of the lower casing 12, as shown in FIG. 2.

Figure 6A:
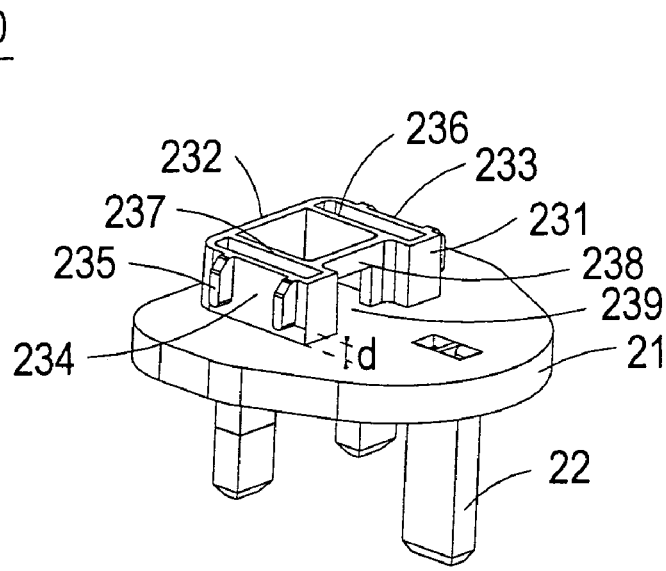
FIGS. 6(*a*) and 6(*b*) are schematic diagrams showing the plug according to the preferred embodiment of the present invention.
Figure 6B:
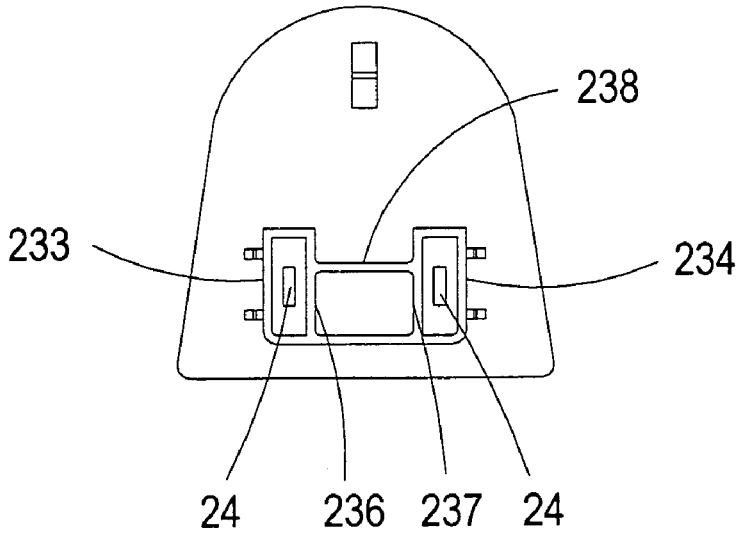

Please refer to FIGS. 6(*a*) and 6(*b*), which are schematic diagrams showing the plug according to the preferred embodiment of the present invention. The plug 20 comprises a plastic body 21, one side thereof having a plurality of conducting terminals 22, and the other side thereof having a base 23 to be received in the depression of the plug-receiving portion 13 on the main body 10 of the electronic device. Certainly, the number and the shapes of the conducting terminals 22 can be designed according to different socket standards but not limited to the three-pin form shown in the figure. Corresponding to the structure of the plug-receiving portion 13 on the main body 10 of the electronic device, the base 23 of the plug 20 comprises a first sidewall 231, a second sidewall 232, a third sidewall 233 and a fourth sidewall 234, and each of the third sidewall 233 and the fourth sidewall 234 has two protrusions 235, which are disposed corresponding to the indentations 15 on the side plates 14 at the two opposite sides of the plug-receiving portion 13, respectively. In addition, the middle part of the base 23 further comprises a first partition 236 and a second partition 237, and the two contacts 24 of the plug 20 are disposed in the depression between the first partition 236 and the third sidewall 233 and in the depression between the second partition 237 and the fourth sidewall 234, respectively, as shown in FIG. 6(*b*), which is a top view of the plug. Moreover, the base 23 further comprises an engaging plate 238 disposed between the first partition 236 and the second partition 237 and near the first sidewall 231. An opening 239 is formed between the engaging plate 238 and the plastic body 21, so that the hook portion 31 of the fixing element 30 can be engaged with the engaging plate 238.

Figure 7:
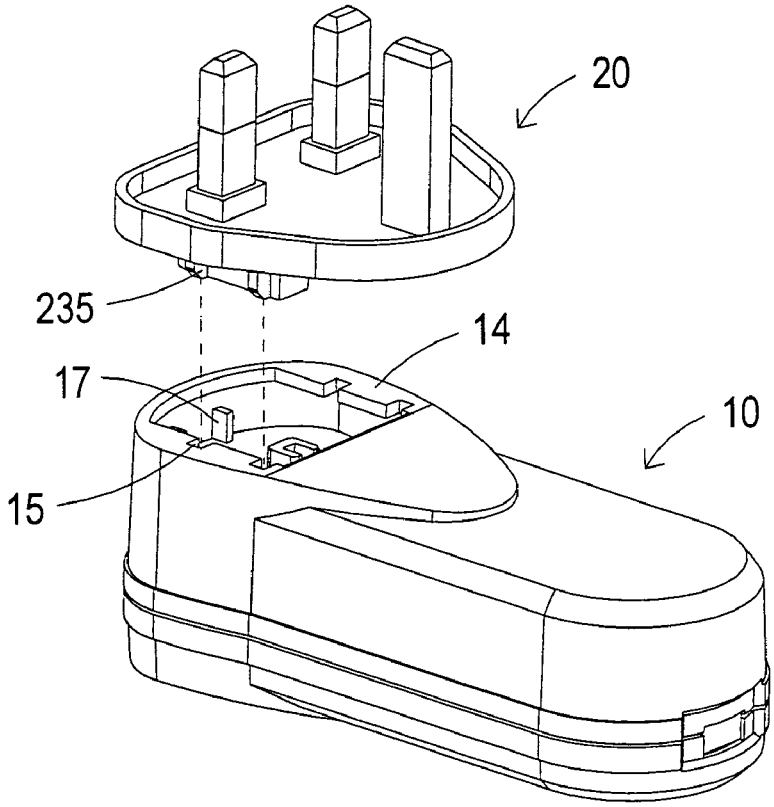
FIG. 7 is a schematic diagram showing the assembling of the plug and the main body of the electronic device according to the preferred embodiment of the present invention.
Figure 8:
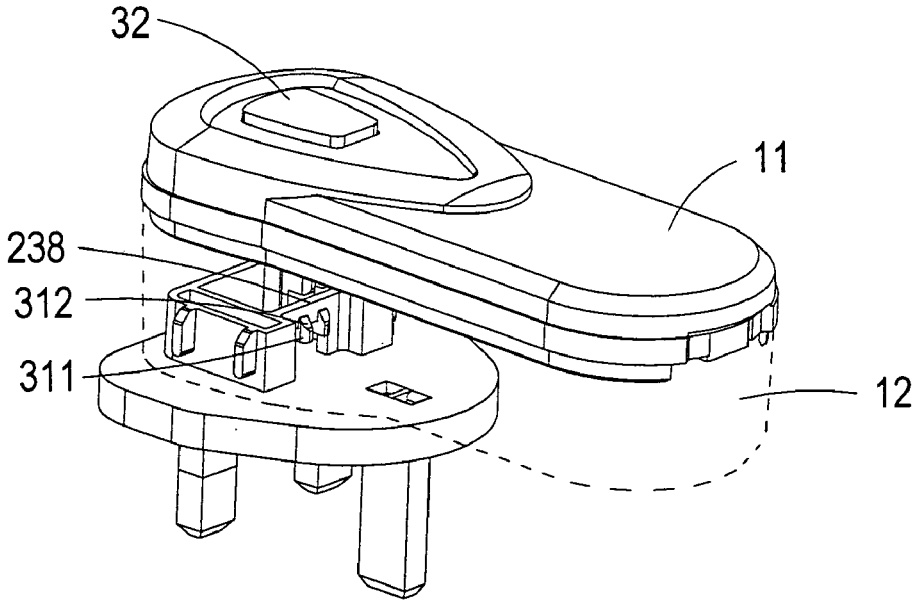
FIG. 8 is a schematic diagram showing the engaging structures of the fixing element and the plug.

The assembling processes of the plug and the main body of the electronic device are described as follow. Please refer to FIG. 7, which is a schematic diagram showing the assembling of the plug and the main body of the electronic device according to the preferred embodiment of the present invention, and please also refer to FIGS. 1–6. First, the base 23 of the plug 20 is disposed above the plug-receiving portion 13 on the main body 10 of the electronic device, and the two protrusions 235 on each of the third sidewall 233 and the fourth sidewall 234 of the base 23 are aligned with the two indentations 15 on each of the side plates 14 at the two sides of the plug-receiving portion 13 to facilitate sliding the base 23 downwardly into the plug-receiving portion 13. Subsequently, the base 23 of the plug 20 is moved toward the blocks 17 in the plug-receiving portion 13 till the second sidewall 232 of the base 23 of the plug 20 touches the blocks 17. While moving the plug 20, the engaging plate 238 on the base 23 of the plug 20 can be slid into the hook portion 31 of the fixing element 30 due to the slant surface 312 on the hook portion 31 and the resilience of the fixing element 30, and further engaged with the engaging hook 311 of the hook portion 31, as shown in FIG. 8 (the lower casing 12 is shown in dotted lines for perspectively illustrating the engaging structures). In the mean time, the two contacts 24 on the plug 20 contact with the two conducting pieces 16 on the plug-receiving portion 13 to conduct the external power to the main body 10 of the electronic device when the plug 20 is plugged into a socket.

In addition, as shown in FIG. 6(*b*), a distance d exist between the protrusions 235 on the base 23 and the plastic body 21 of the plug 20, which is substantially equal to the thickness of the side plates 14 at the two sides of the plug-receiving portion 13. When the base 23 of the plug 20 is slid into the plug-receiving portion 13 and moved to the engaging position, the protrusions 235 are not aligned with the indentations 15 on the side plates 14 anymore but engaged with the side plates 14. Therefore, in addition to the engagement between the engaging plate 238 of the plug 20 and the hook portion 31 of the fixing element 30, the engagement between the protrusions 235 and the side plates 14 enhances the engagement between the plug 20 and the main body 10 of the electronic device in the vertical direction. Accordingly, the plug 20 can be more effectively secured on the main body 10 of the electronic device, so as to prevent the electric shock upon pulling out the electronic device.

Figure 9:
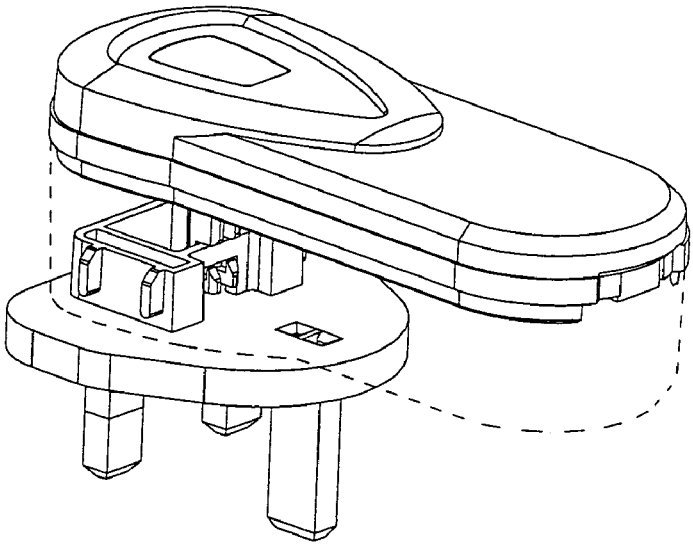
FIGS. 9–10 show the dissembling process of the plug and the main body of the electronic device according to the preferred embodiment of the present invention.
Figure 10:
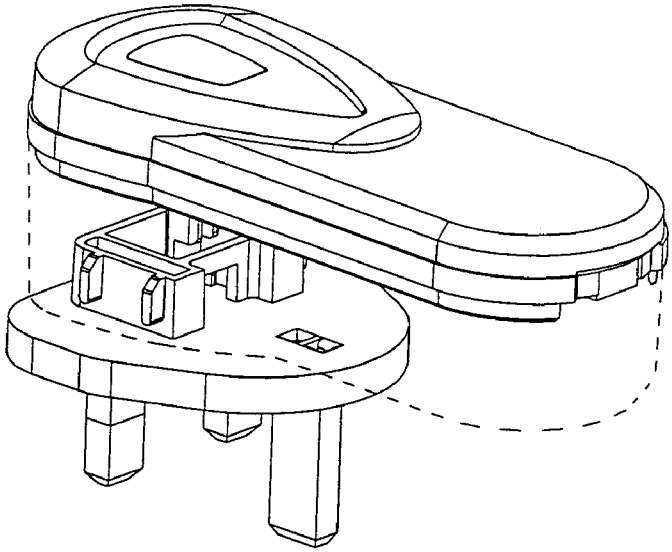

On the other hand, the present invention also provides structures that facilitate dissembling the plug from the main body of the electronic device. As described above and please refer to FIGS. 8–10, the fixing element 30 has a press portion 32, which is exposed on the outer surface of the upper casing 11 after the fixing element 30 is assembled on the main body 10 of the electronic device. When dissembling the plug 20 from the main body 10 of the electronic device, an external force is applied to the press portion 32 to move the fixing element 30 downwardly, so that the engaging hook 311 of the hook portion 31 is not engaged with the engaging plate 238 of the plug 20 anymore, as shown in FIG. 9. Then, the plug 20 can be moved backward to separate the engaging hook 311 of the hook portion 31 away from the engaging plate 238 through the opening 239 between the engaging plate 238 and the plastic body 21, as shown in FIG. 10. When the protrusions 235 of the plug 20 are aligned with the indentations 15 on the side plates 14 again, the plug 20 can be easily taken out from the main body 10 of the electronic device. Therefore, when the plug 20 is going to be dissembled from the main body 10 of the electronic device, the user only needs to hold the main body 10 of the electronic device by one hand and press the press portion 32 of the fixing element 30 with a finger, and move the plug 20 to the releasing position by the other hand; as a result, the plug 20 can be easily separated from the main body 10 of the electronic device. Furthermore, the electronic device comprises the spring 40 disposed between the press portion 32 of the plug 30 and the main body 10, so the fixing element 30 can return to the original position because of the resilience of the spring 40 after the plug 20 is separated from the main body 10, and is ready for the next assembling with the plug 20.

In addition, as shown in FIG. 1, when the plug 20 is well assembled with the main body 10 of the electronic device and the conducting terminals 22 of the plug 20 are plugged into the socket, a space for air convection is provided between the main body 10 of electronic device and the socket due to the specific thickness of the plastic body 21 of the plug 20, which improves the heat-dissipating effect of the electronic device. Further, the thickness of the plastic body 21 is also beneficial to the holding for the user, which facilitates the assembling and dissembling of the plug 20 and the main body 10 of electronic device.

In conclusion, the present invention provides an electronic device with a replaceable plug, wherein the plug can be replaced to adapt to different socket standards, and the plug and the main body of the electronic device can be easily assembled and dissembled, which brings great convenience to the people who go abroad for business or travel frequently. In addition, the plug of the present invention can be effectively secured on the main body of the electronic device, so the danger of electric shock caused from the condition that the plug remains on the socket upon pulling out the electronic device due to the ineffective securing of the plug can be prevented; also, the power failure or data loss caused from the loosening of the plug under the operation state can be avoided. Further, the design of the plug according to the present invention is advantageous to the heat-dissipation of the electronic device. Therefore, the present invention overcomes the disadvantages of the prior art and possesses industrial value.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An electronic device with a replaceable plug, comprising:

a main body having an upper casing and a lower casing, said lower casing having a plug-receiving portion disposed at a bottom thereof;

a fixing element having a hook portion and a press portion, said hook portion protruded in said plug-receiving portion and said press portion disposed on a surface of said upper casing; and a plug having a plurality of conducting terminals and an engaging plate to be engaged with said hook portion of said fixing element;

wherein said plug is assembled in said plug-receiving portion of said main body via an engagement between said engaging plate of said plug and said hook portion of said fixing element, and dissembled from said main body by pressing said press portion.

2. The electronic device with a replaceable plug according to claim 1 wherein said electronic device is a power converter.

3. The electronic device with a replaceable plug according to claim 2 wherein said power converter is an adaptor or a charger.

4. The electronic device with a replaceable plug according to claim 1 wherein said plug-receiving portion is a depression.

5. The electronic device with a replaceable plug according to claim 1 wherein said plug-receiving portion comprises two side plates disposed at two sides thereof.

6. The electronic device with a replaceable plug according to claim 5 wherein said side plates are extended inwardly from bottom edges of said lower casing.

7. The electronic device with a replaceable plug according to claim 5 wherein each of said side plates comprises at least an indentation.

8. The electronic device with a replaceable plug according to claim 7 wherein said plug further comprises at least a protrusion disposed correspondingly to said indentation of said side plate.

9. The electronic device with a replaceable plug according to claim 1 wherein said plug-receiving portion further comprises at least a block.

10. The electronic device with a replaceable plug according to claim 1 wherein said plug-receiving portion further comprises at least a conducting piece.

11. The electronic device with a replaceable plug according to claim 10 wherein said plug further comprises at least a contact to conduct with said conducting piece in said plug-receiving portion.

12. The electronic device with a replaceable plug according to claim 1 wherein said plug further comprises a plastic body and a base to be received in said plug-receiving portion.

13. The electronic device with a replaceable plug according to claim 12 wherein said engaging plate is disposed on said base.

14. The electronic device with a replaceable plug according to claim 1 wherein said fixing element further comprises a connecting portion for connecting said hook portion and said press portion.

15. The electronic device with a replaceable plug according to claim 1 wherein said hook portion comprises an engaging hook at an end thereof.

16. The electronic device with a replaceable plug according to claim 15 wherein said engaging hook has a slant surface.

17. The electronic device with a replaceable plug according to claim 1 wherein said fixing element further comprises at least a hook piece.

18. The electronic device with a replaceable plug according to claim 17 wherein said upper casing of said main body further comprises at least an engaging piece to be engaged with said hook piece.

19. The electronic device with a replaceable plug according to claim 17 wherein said hook piece is extended downwardly from said press portion.

20. The electronic device with a replaceable plug according to claim 1 further comprising a spring disposed between said press portion and said upper casing.

* * * * *